US005394564A

United States Patent [19]

Rodriguez

[11] Patent Number: 5,394,564

[45] Date of Patent: Mar. 7, 1995

[54] UMPIRE'S STRIKE ZONE MASK

[76] Inventor: David G. Rodriguez, 5 Sandlewood, Beaumont, Tex. 77706

[21] Appl. No.: 60,857

[22] Filed: May 12, 1993

[51] Int. Cl.[6] ..... A41D 13/00

[52] U.S. Cl. ..... 2/9; 2/424; 273/26 C

[58] Field of Search ..... 2/9, 424, 425, 8, 6.1, 2/6.2, 422, 10, 15, 427; 351/158, 46; 273/26 A, 26 C, 25, 187.2, 187.6

[56] References Cited

U.S. PATENT DOCUMENTS

| | | | |
|---|---|---|---|
| 376,278 | 1/1888 | Barnard . | |
| 379,655 | 3/1888 | O'Sullivan . | |
| 924,613 | 6/1909 | Hellawell | 2/9 |
| 2,020,248 | 11/1935 | Shibe | 2/9 |
| 2,281,152 | 4/1942 | Hollingsworth | 2/9 |
| 3,029,517 | 4/1962 | Frey | 33/64 |
| 3,436,151 | 4/1969 | Conrose | 356/72 |
| 3,487,549 | 1/1970 | Engesser | 33/46 |
| 3,729,745 | 5/1973 | Latina | 2/9 |
| 3,732,574 | 5/1973 | Hale | 2/9 |
| 4,031,564 | 6/1977 | Wood | 2/9 |
| 4,059,347 | 11/1977 | Eitel | 350/319 |
| 4,168,111 | 9/1979 | Baines | 351/46 |
| 4,251,076 | 2/1981 | Krupicka | 351/158 |
| 4,343,534 | 8/1982 | Gruskin | 350/319 |
| 4,531,743 | 7/1985 | Lott | 273/183 B |
| 4,991,849 | 2/1991 | Fabanich | 351/158 |
| 5,001,786 | 3/1991 | Copeland | 2/424 |

*Primary Examiner*—Clifford D. Crowder
*Assistant Examiner*—Michael A. Neas
*Attorney, Agent, or Firm*—Guy V. Manning

[57] ABSTRACT

A strike zone mask provides an image of a batter's strike zone for increasing the precision with which an umpire may judge whether or not a pitched ball was a strike. A lens carriage is provided within the viewing opening of the mask, the carriage and lens intercepting the umpire's field of vision in one eye. Lenses within the carriage have vertical scored lines defining the horizontal width of home plate, and a horizontal bar adjustably affixed to the front of the carriage across the lower portion of the lens permits adjusting the height of the strike zone to different players by aligning the top of the lens with the batter's shoulders and the horizontal bar with his knees.

14 Claims, 4 Drawing Sheets

UMPIRE'S STRIKE ZONE MASK

BACKGROUND OF THE INVENTION

1. Field of the Invention

This invention relates generally to optical devices for visually gauging the location of moving objects in relation to other stationary objects. More particularly, it relates to improvements to umpires' masks worn by baseball umpires when calling strikes and balls behind home plate, and yet more particularly to an optical device attached to such mask to assist an umpire in gauging pitched balls in relation to a batter's strike zone.

2. Description of Related Art

In the popular sport of baseball, the chief officiating referee, or umpire, typically stands or crouches directly behind the catcher where he can best view a pitched ball as it crosses home plate. For the ball to be a strike, it must penetrate the batter's individual strike zone lying in a plane normal to a straight line between the pitcher's mound and home plate. The strike zone is defined as a rectangular section of that plane suspended directly above and exactly as wide as home plate and having as its top and bottom limits a horizontal projection of the batter's shoulder and knee elevations. Obviously, the strike zone elevation and vertical height varies with each batter while its width remains constant.

The umpire currently must mentally envision the strike zone for each batter and carefully compare the baseball's position in relation to the imagined rectangular zone as the ball crosses home plate. Likewise, the pitcher imagines the strike zone and tries to penetrate it with the ball while trying to fool the batter into thinking he has missed it and foregoing a swing, thereby counting a strike against the batter when the umpire calls the pitch a strike. Though the umpire's judgment as to called strikes is traditionally final, it is subject to second guessing, disagreement and suggestions for vision improvements for the umpire by disgruntled spectators and players alike. An optical device to assist the umpire in making his call not only would lend a desirable element of precision to his assessment, but it would greatly reduce the propensity of others to presume upon his authority and to disagree with his call.

Numerous optical devices worn on a user's head have been offered to assist in performing sports, but, oddly enough, I have found none devised for an umpire. For example, Conrose, U.S. Pat. No. 3,436,151, provides a pair of spectacles which assists a golfer with putt alignment by providing a horizontal line scored onto the back of one or both lenses behind a mirrored concave ridge on the front of the lenses. Vertical lines also on the lens help gauge club alignment, and Conrose suggests a baseball application whereby the pitcher may use the lines to visualize the batter's strike zone. Being permanently scored onto spectacle lenses, of course, Conrose's device does not permit adjustment of the image, a highly desirable feature to an umpire using it behind home plate, where visual variations in size of the strike zone are significantly more apparent than to a pitcher as much as sixty feet away.

SUMMARY OF THE INVENTION

Accordingly, it is an object of this invention to provide a device to assist an umpire in assessing the position of a pitched ball in relation to a batter's strike zone.

It is another object of this invention to provide a device that lends an element of objective precision to the task of calling balls and strikes behind home plate.

It is another object of this invention to provide an optical device integral with an umpire's mask for projecting an image of a strike zone over home plate.

It is yet another object of this invention to provide such a device which is readily adjustable to the differing strike zones of individual batters.

The foregoing and other objects of this invention are achieved by providing a strike zone mask which projects an image of a batter's strike zone within the umpire's field of vision for increasing the precision with which he may judge whether or not a pitched ball is a strike. A lens carriage within the view opening of the mask intercepts the umpire's field of vision in one eye. At least one lens within the carriage has vertical lines superimposed upon it to define the horizontal width of home plate, and a horizontal bar adjustably affixed to the front of the carriage across the lower portion of the lens permits adjusting the height of the strike zone to different batters. To use the mask, the umpire fixes the carriage in front of the eye selected for his gauging eye and, while looking through the lens, aligns the top of the carriage with the batter's shoulders and the horizontal bar with his knees. The umpire then contrasts pitched balls with the projected visible strike zone as the balls cross home plate.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 3:
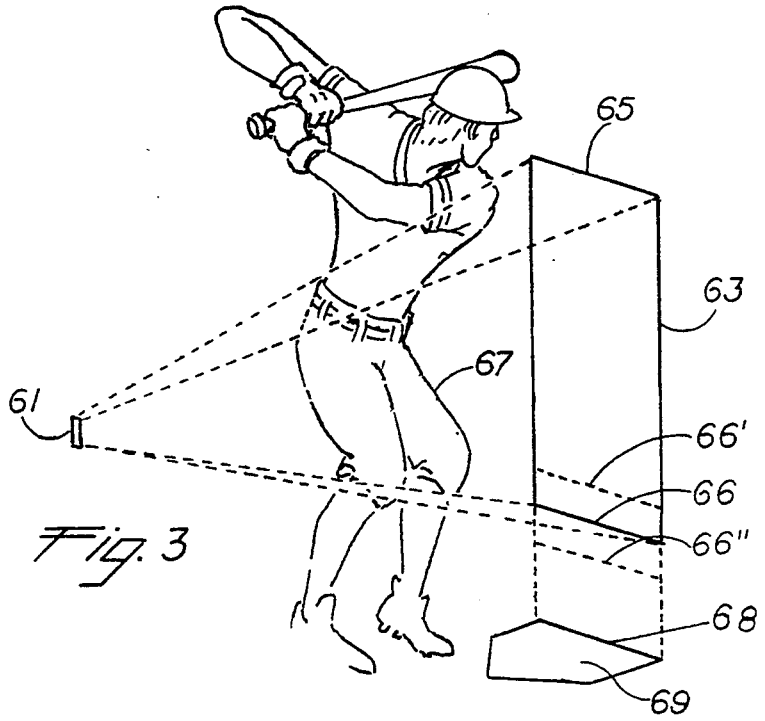
FIG. 3 shows in perspective the strike zone projection created by the invention.

With reference now to the figures, and in particular to FIG. 3, a baseball batter 67 is depicted in a batting stance beside home plate 69. An image of the batter's strike zone 63 appears beside him and comprises a vertical rectangle suspended in a plane directly above front edge 68 of home plate 69, with the horizontal width of strike zone 63 matching front edge 68 of home plate 69. Top 65 and bottom 66 limits of strike zone 63 correspond to the shoulder and knee heights respectively of batter 67. Projection lines illustrate that the visible image of strike zone 63 thus defined emanates from aperture 61, the composition of which will be discussed hereinafter. Alternate lower limits 66' and 66'' of strike zone 63 depict alternate positions of lower limit 66 induced by varying the vertical height of aperture 61 as discussed below.

Figure 2:
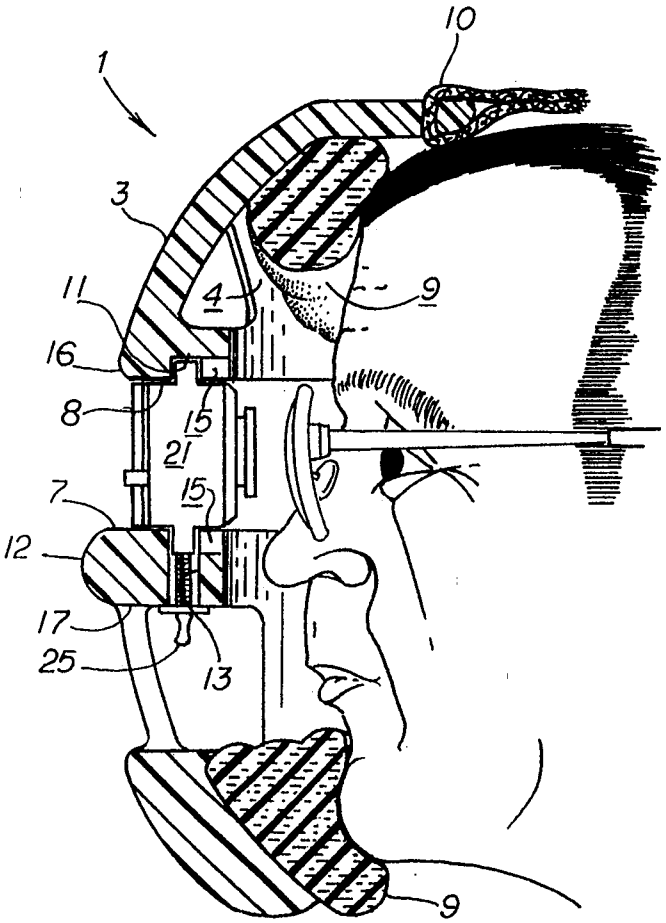
FIG. 2 shows a right elevational section through the centerline of the mask of FIG. 1 as worn by an umpire.

Referring now to FIGS. 1, 2, 4, 5, 5A & 5B, umpire's mask 1 comprises a curved, substantially convex front 3, corresponding concave back 4, and attachment means comprising straps 10 that surround the wearer's head to hold mask 1 on his face, as depicted in FIG. 2. Mask 1 is equipped with padding 9 to cushion a wearer's face and position mask 1 such that the wearer looks through a substantially rectangular opening 5 serving as a view port transverse the vertical centerline (axis A, coincident with Section 2—2 of FIG. 1) of mask 1. Mask 1 is substantially symmetric about a bifurcating plane through centerline axis A.

Figure 4:
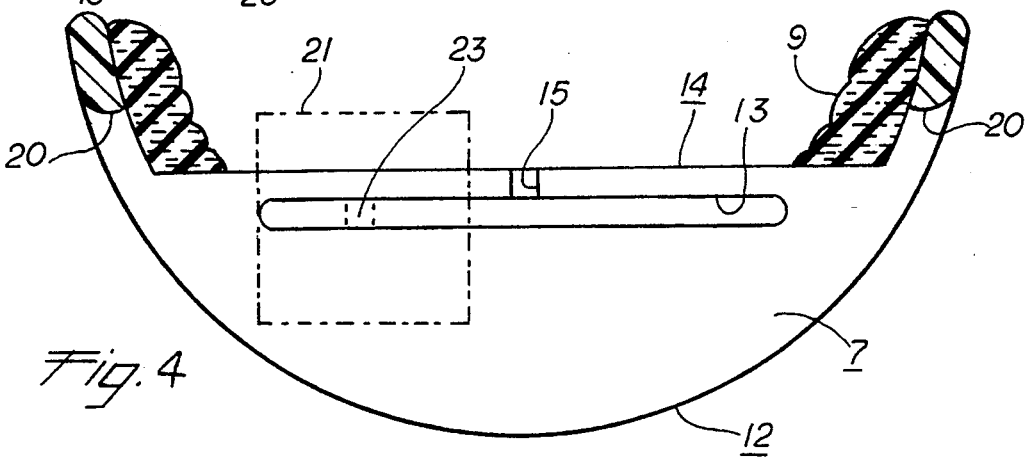
FIG. 4 details the lower deck of the viewing opening in the mask of FIG. 1.

Opening 5 is defined by horizontal deck 7 (see FIG. 4) and ceiling 8 separated by side posts 20 of mask 1, deck 7 and ceiling 8 both having a front edges 12, 16 and back edges 14, 18. As best seen in FIG. 4, deck 7 includes channel 13 communicating with bottom surface 17 of deck 7 and paralleling back edge 14 a substantial portion of the longitudinal length of opening 5. Matching groove 11 in ceiling 8 may, but need not, penetrate the depth of ceiling 8 as channel 13 penetrates the depth of deck 7. Groove 11 is positioned directly above and parallel to channel 13 and matches its length. Passages 15 communicate between groove 11 and channel 13 and their respective back edges 18, 14.

Mask 1 spans the vertical separation between deck 7 and ceiling 8 and comprises a substantially rectangular box having horizontal top 22 and bottom 24 separated by vertical left 26 and right 28 (as viewed by the wearer) exterior sides. Interior walls corresponding to the exterior top 22, bottom 24 and sides 26, 28 define internal cavity 29 having longitudinal axis B. Cavity 29 is open at one end proximate back edges 14, 18, while lip 30 at the opposite end of cavity 29 defines window 27 which communicates between cavity 29 and the front of carriage 21 and mask 1. Carriage 21 bears lugs 23 centered on top 22 and bottom 24. Thumbscrew 25 penetrates channel 13 from bottom surface 17 of deck 7 to cooperate with female threads in lug 23 on bottom 24 to sandwich deck 7 between bottom 24 and shoulder 34, thereby providing a means for adjustably fixing the position of carriage 21 transverse axis A of mask 1 within opening 5.

Figure 1:
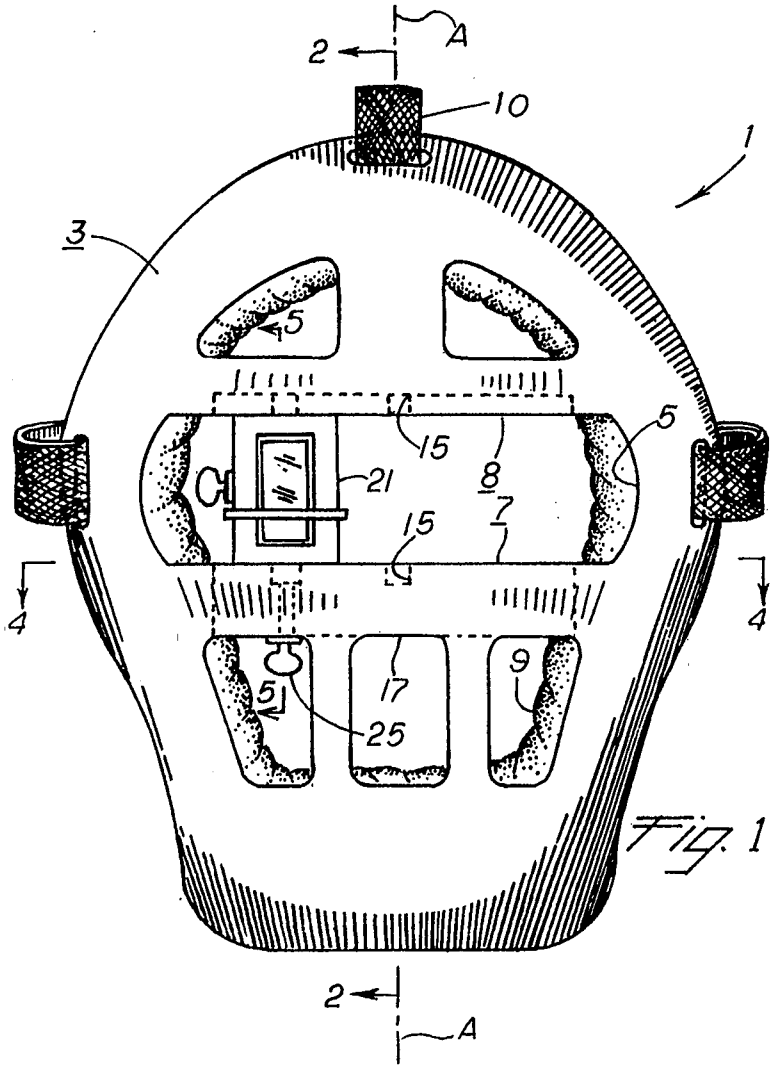
FIG. 1 depicts a front elevational view of an umpire's mask fitted with the optical device.

Lugs 23 cooperate with channel 13 and groove 11 to confine travel and orientation of carriage 21 to translation along the longitudinal length of opening 5 between side posts 20. Passages 15 permit insertion and removal of carriage 21 from mask 1 by providing simultaneous access to channel 13 and groove 11 for lugs 23. Though passages 15, as depicted with hidden lines in FIG. 1, are shown as coincident with the vertical centerline axis A of mask 1, one having ordinary skill in the art will recognize that they need only be vertically aligned with each other somewhere along the lengths of channel 13 and groove 11.

Lugs 23 are preferably substantially rectangular with sides parallel axis B and sized to fit snugly into channel 13 and groove 11. Since channel 13 and groove 11 lie perpendicular to a plane bifurcating mask 1 along centerline A, translation of carriage 21 along the length of opening 5 will keep axis B of carriage 21 oriented directly forward of mask 1 and facing a direction parallel to said bifurcating plane, regardless of the transverse position of carriage 21 in opening 5. Therefore, whether located in front of the wearer's left or right eye, carriage 21 will be oriented in the same direction forward of carriage 21.

Received within cavity 29 is sash 35 comprising a substantially rectangular cylinder having horizontal top and bottom and vertical sides sized to fit snugly but slidably inside the interior walls of carriage 21. Corresponding interior walls of sash 35 define internal chamber 39 coaxial with cavity 29. Carried within chamber 39 is at least one lens 41 transverse axis B. One having ordinary skill in the art will recognize that multiple, coordinated lenses may achieve better optical results that a single lens 41 and that all such lens arrangements are within the spirit and scope of the present invention. Thumbscrew 33 penetrates slot 31 in right side wall 28 of carriage 21 and cooperates with female threads in the right side wall of sash 35 to secure sash 35 in a position along axis B within cavity 29. Thumbscrew 33 thus serves as a means of focusing lens 41 to the eye of the wearer of mask 1 by relocating sash 35 along axis B toward or away from the wearer's face. One having ordinary skill in the relevant art will recognize that slot 31 may be in left side wall 26 and, in fact, may be provided on both sides 26, 28 (not shown) to permit reversal of sash 35 so that thumbscrew 33 does not obscure the vision of the umpire's other eye.

Figure 7:
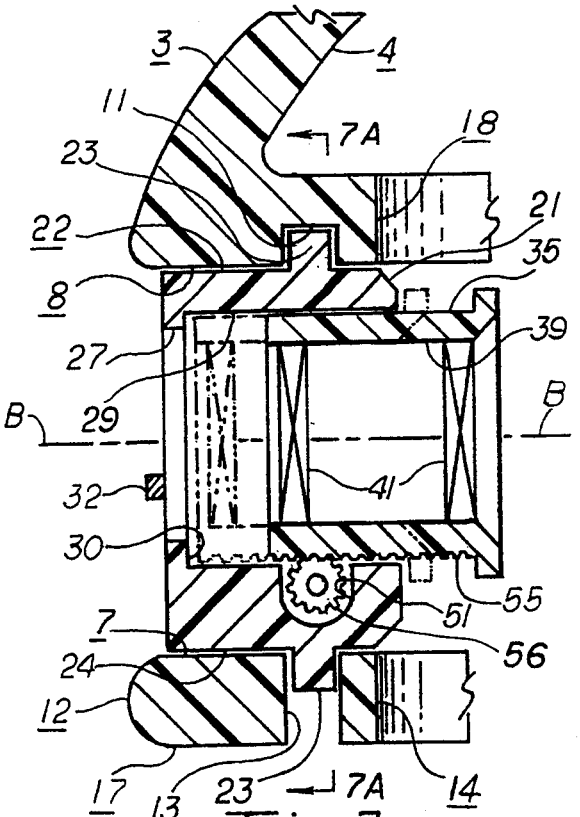
FIG. 7 is a section view corresponding to FIG. 5 but of another alternate embodiment of the optical device of FIG. 1.
Figure 7A:
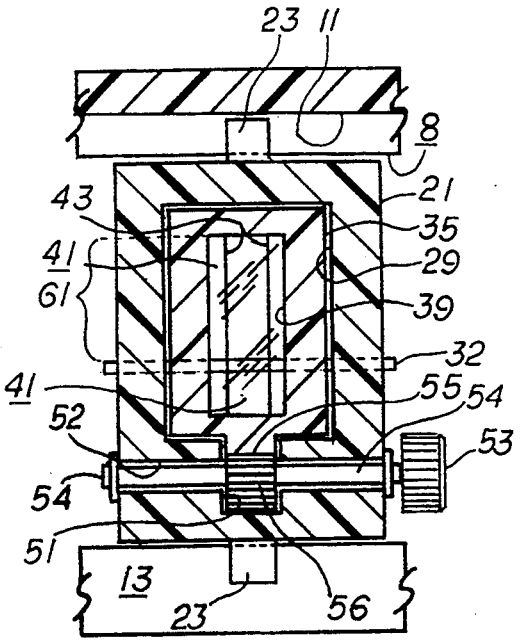
FIG. 7A is a rear elevational section comparable to FIG. 5B but of the embodiment of FIG. 7.

FIGS. 7 and 7A depict a focusing means alternative to thumbscrew 33. Shaft 54 cooperates with bore 52 communicating between left 26 and right 28 sides of carriage 21. Shaft 54 terminates on one end in knob 53, and pinion gear 56 carried on and coaxial with shaft 54 cooperates with recess 51 to rotate in a vertical plane in response to rotation of knob 53. Teeth of rack gear 55 carried on the bottom exterior wall of sash 35 cooperates with the teeth of pinion 56 to move sash 35 longitudinally along axis B in response to such rotation of knob 53 and pinion 56. As shown in FIG. 7, sash 35 may occupy a plurality of positions along axis B, and knob 53 thus provides an alternate means of smoothly focusing lens 41 to the eye of a wearer of mask 1. Being vertically located beneath the line of sight of the umpire's eyes, knob 53 would not obscure the umpire's naked eye.

Horizontal bar 32 spans across window 27 of carriage 21. Fingers 36 on either end of bar 32 cooperate with vertical notches 38 in exterior side walls 26, 28 to confine movement of bar 32 in the vertical dimension. Bar 32 is preferably made of resilient material such as metal, and fingers 36 are crimped into frictional contact with notches 38 such that bar 32 will be self-supporting in its vertical position but remain slidably adjustable. One having ordinary skill in the art will recognize that other mechanisms for achieving vertical adjustability of bar 32 are readily available and considered within the spirit and scope of the present invention.

Figure 5:
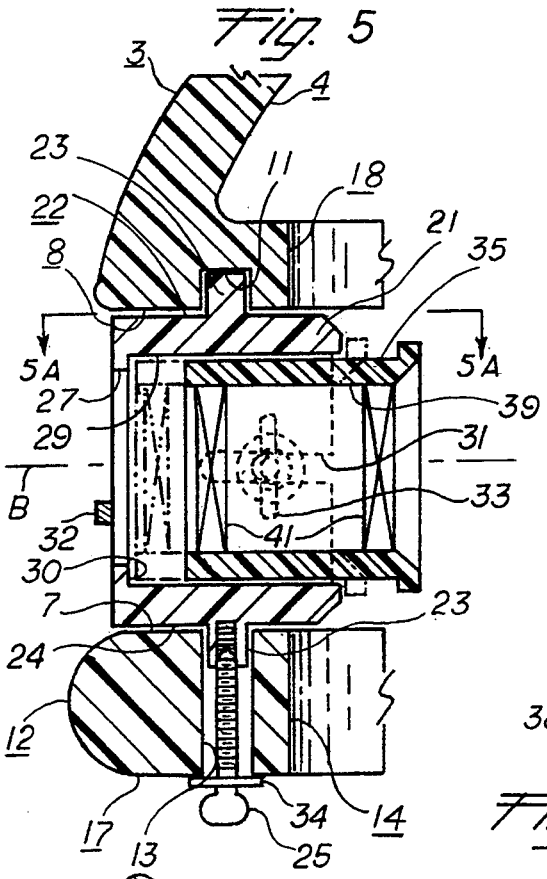
FIG. 5 is a cross section through the vertical centerline of the optical device of the mask of FIG. 1.
Figure 5B:
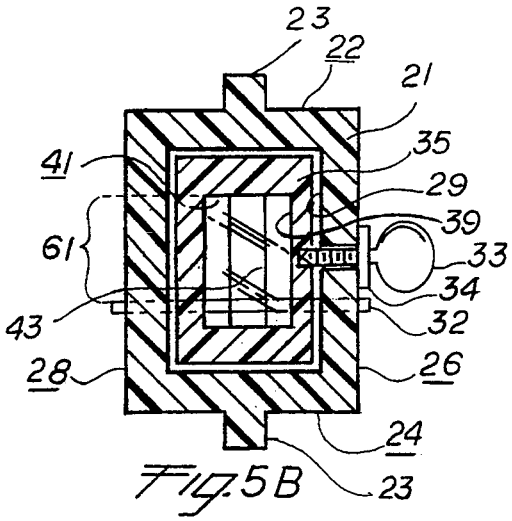
FIG. 5B is a rear elevational section of the optical device of FIG. 1 along the section lines of FIG. 5A.
Figure 5A:
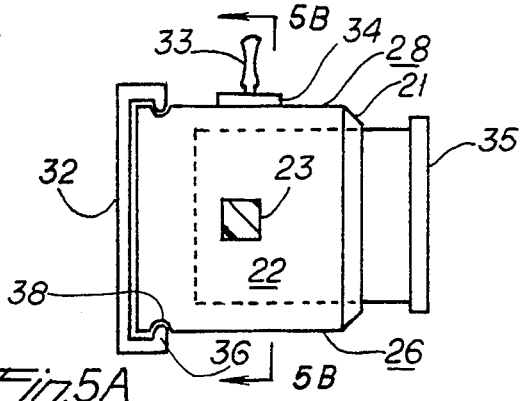
FIG. 5A is a plan section of the optical device of FIG. 5.

As depicted in FIGS. 5B and 7A, bar 32 is visible through window 27 to the wearer of mask 1 when carriage 21 is positioned in front of one eye. Bar 32 thereby defines lower limit 66 of aperture 61, while the top of chamber 39 or lip 30 at the top of window 27 defines the upper limit 65 of aperture 61. Vertical relocation of bar 32 results in alternate lower limits 66' and 66'' depicted in FIG. 3. One having ordinary skill in the art will recognize that two bars 32 (not shown) could be provided to define both upper limit 65 and lower limit 66.

Figure 6:
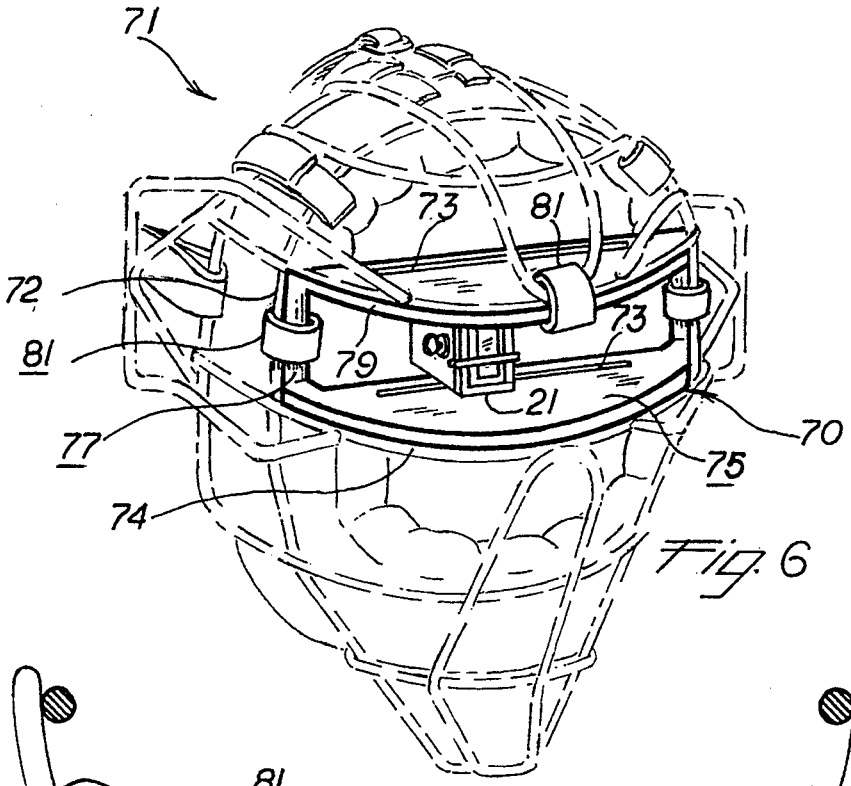
FIG. 6 is a perspective view of an alternate embodiment of the invention.
Figure 6B:
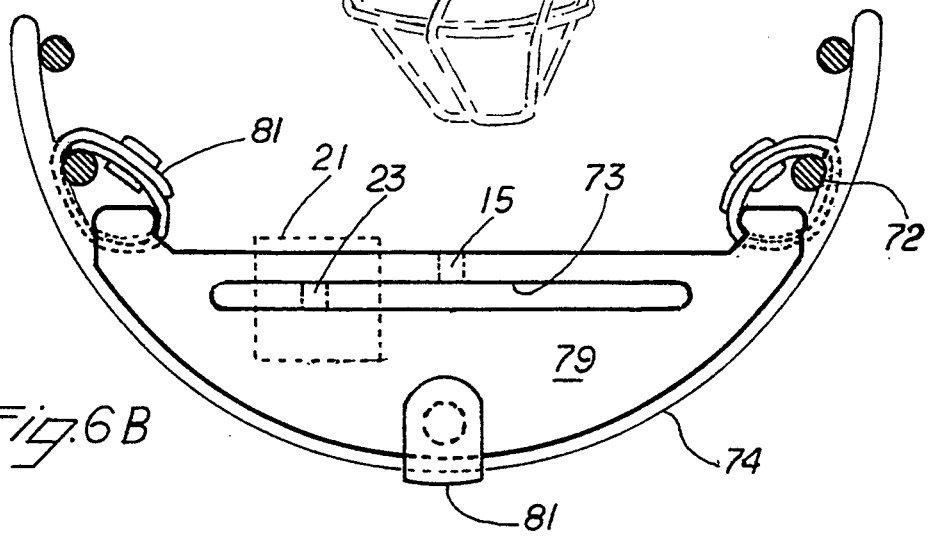
FIGS. 6A and 6B are front elevational and top plan views respectively of the alternate embodiment of FIG. 6.
Figure 6A:
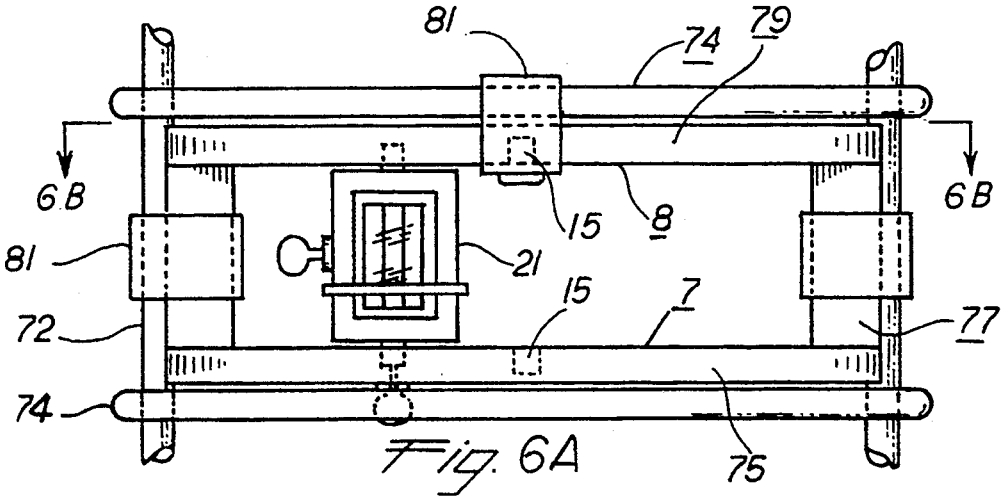

As seen in FIGS. 5B, 6A & 7A, two vertical lines 43 are superimposed onto lens 41 and serve to define the horizontal width of aperture 61 within the umpire's field of vision. Vertical lines 43 may by etched or painted directly onto lens 41, or they may be provided by other suitable means. For example, lines 43 may be provided on otherwise transparent templates and inserted into chamber 39 juxtaposed lens 41. In such case, they can be made removable and alternate templates could be provided for other specialized applications. One having ordinary skill in the art will recognize that all such methods of providing vertical lines 63 are within the spirit and scope of the present invention.

The separation between vertical lines 43 depends upon the distance from home plate 69 at which mask 1 will be used. Typically, the umpire stands or crouches approximately six (6) feet behind the front edge of home plate 69. At such distance, and for an optical lens 41 having a focal length of one (1") inch, vertical lines 43 preferably would be separated by approximately one fourth (¼") inch for a home plate of seventeen (17") inches in width. Obviously, if the device were used at different distances, such as where the umpire stands behind the pitcher instead of the catcher, different separations of vertical lines 43 would be required, depending upon the distance from home plate 69 to the pitcher's mound. For the latter arrangement, in fact, significant variations would be required since pitchers mounds vary considerably in their distance from home plate 69, depending upon the baseball league in question. For use behind home plate 69, however, separation of lines 43 would vary insignificantly because the umpire's position varies almost none from one league to another.

Aperture 61, thus defined by vertical lines 43, bar 32 and lip 27, is projected within the field of vision of the wearer and visibly creates an adjustable image of strike zone 63 at a specific distance from carriage 21, in fashion similar to the projection of snapshot perimeters in the viewfinder of a rangefinder camera. Perimeter regions of lens 41 outside aperture 61 provide peripheral visibility of regions around strike zone 63.

FIGS. 6–6B depict an alternate embodiment to mask 1. FIG. 6 depicts in upper front perspective transom 70 attached to wire mask 71 within the view port thereof. Transom 70 comprises floor 75 and roof 79 separated by posts 77 defining an opening comparable to opening 5 of mask 1 depicted in FIG. 1. Channels 73 communicate through floor 75 and roof 79 parallel to the back edges thereof as does channel 13 through deck 7 of mask 1. Carriage 21 bearing lugs 23 cooperating with channels 73 translates along the length of transom 70 in like fashion as it does in mask 1, and thumbscrew 25 fixes carriage 21 in a selected position. All other features of carriage 21 are as described for mask 1, including the alternate focusing embodiment of FIGS. 7 & 7A.

Attachment straps 81 are provided on side posts 77 and roof 79 for attaching transom 70 to mask 71. Straps 81 surround vertical braces 72 and horizontal crosspiece 74 and are secured to themselves to snugly affix side posts 77 to braces 72 and roof 79 to crosspiece 74 as shown. One having ordinary skill in the art will recognize that alternate attachment devices, such as VELCRO strips or string ties will accomplish the same purposes, and that other attachment configurations will readily substitute, all of which are considered within the spirit and scope of the present invention.

In operation, an umpire dons mask 1 or 71 and locates carriage 21 in front of one eye or the other, as he prefers, securing it into position with thumbscrew 25. He then looks through window 27 and adjusts the focus of lens 41 for his eye using focusing means provided, either thumbscrew 33 or knob 53. Once carriage 21 is positioned as he prefers, the umpire then moves his head left to right to align vertical lines 41 above the corners of home plate 69. He then tilts his head to match upper limit 65 to the shoulders of batter 67. Finally, he adjusts bar 32 to align it with the knees of batter 67, thereby defining strike zone 63 for batter 67. He then can contrast balls thrown by the pitcher (not shown) with projected strike zone 63 as they cross home plate 69 to assess whether or not the pitches are strikes. When a new batter arrives at home plate 69, the umpire need only repeat the steps of aligning upper limit 65 with the batter's shoulders and, if necessary, adjusting bar 32 to redefine lower limit 66 (66' or 66'') as needed to redefine projected strike zone 63.

Carriage 21 and transom 70 are preferably fabricated from one of a number of thermoset plastics known as polycarbonate resins (e.g. "LEXAN" by General Electric Company) having characteristics of being resistant to ultraviolet for outdoor use, easily molded, machinable and light in weight. Since the mask may receive some mistreatment during a game, such as when an umpire throws off mask 1 or 71 in order to view closely a play at home plate 69, carriage 21 should be resistant to impact and moment loading, especially at lugs 23. Masks 1, 71 preferably are fabricated from metal, such as aluminum or steel, but may be made from any materials having characteristics of impact resistance, easily molded, machinable and light in weight. One having ordinary skill in the art will recognize that other materials, such as metal, hard rubber, wood or even tempered glass or ceramics may prove to be suitable substitutes for carriage 21 without departing from the spirit and scope of the present invention. Likewise, one having ordinary skill in the art will recognize that masks 1, 71 need not be made from the same materials as carriage 21 and transom 70, and, in the latter, retrofit case of mask 71, likely will not be.

While the invention has been particularly shown and described with reference to a preferred embodiment, it will be understood by those skilled in the art that various changes in form and detail may be made therein without departing from the spirit and scope of the invention. For example, cavity 29, sash 35 and chamber 39 need not be cylinders of rectangular cross section, but could have other shapes such as ovals or circles. Also, other fixing means besides thumbscrew 25 could be provided, such as clamps gripping upper or lower perimeters of view port 5 which would not require channel 13 or groove 11, but would substitute suitable alternatives. Likewise, carriage 21 could be permitted to rotate about a vertical axis so that its orientation relative to the aforementioned bifurcating plane could be varied. Finally, this invention could have alternate applications in other sports as well as other pursuits where precision gauging of vertical and horizontal limitations are desirable.

I claim:

1. A strike zone umpire's mask comprising a generally ovate face shield symmetric about a vertical axis and adapted to be attached to the umpire's head and to cover his face;

a horizontal opening in front of the umpire's eyes, the opening having a longitudinal length transverse the shield axis, a lower deck and an upper ceiling, the deck and ceiling each having horizontal top and bottom surfaces and front and back edges;

a carriage coupled to the mask within the opening, the carriage having a front, a longitudinal axis normal to the front, exterior and interior top, bottom and side walls surrounding the axis and defining a cavity open opposite the front, and a window at the front communicating between the cavity and the exterior of the carriage;

fixing means for adjustably fixing the carriage along the length of the opening in front of at least one of the umpire's eyes, said eye serving as a gauging eye; and image means carried within the carriage for creating an image of a strike zone within the field of vision of the umpire's gauging eye.

2. The mask according to claim 1 wherein the image means comprises lens holder means adapted to be received within the cavity for holding at least one lens between the window and the umpire's eye;

focus means for focusing the lens;

vertical lines superimposed onto a surface of the lens; and a horizontal bar adjustably coupled to the front of the carriage across the window.

3. The mask according to claim 2 wherein the lens holder means comprises a box adapted to be received within the cavity, the box having an interior chamber coaxial with the cavity, the box further having two viewing ports transverse the box axis on opposing ends of the box and communicating between the chamber and the cavity; and at least one lens within the chamber between the viewing ports.

4. The mask according to claim 2 wherein the focus means comprises a slot communicating between the cavity and one exterior side wall of the carriage; and a thumbscrew extending through the slot and into a threaded recess within the side of the lens holder means, the thumbscrew having a shoulder larger in diameter than the width of the slot.

5. The mask according to claim 2 wherein the focus means comprises a shaft carried within and extending the length of a bore communicating between opposing sides of the carriage and transverse the mask axis, the shaft terminating at one end with a thumb knob;

a pinion gear carried on the shaft and adapted to be received within a cylindrical recess coaxial with the bore;

a rack gear carried on the lens holder means and adapted to cooperate with the pinion gear for moving the lens holder means longitudinally within the cavity in response to rotation of the thumb knob.

6. The mask according to claim 1 wherein the fixing means comprises a channel communicating between the top and bottom surfaces of the deck transverse the mask axis;

a groove in the bottom surface of the ceiling parallel the channel;

a lug on each of the top and bottom walls of the carriage, one each of the lugs adapted to be received within the channel and the groove; and a thumbscrew penetrating the channel and into a threaded recess within the lug on the bottom of the carriage, the thumbscrew having a shoulder larger in diameter than the width of the channel.

7. An improved umpire's mask, the mask comprising a generally ovate shield symmetric about a vertical axis and adapted to attach to and substantially to cover the umpire's face, the shield having a generally rectangular viewing port transverse the axis and in front of the umpire's eyes when the shield is attached to the umpire's face, the viewing port being defined by vertical braces and horizontal crosspieces of the mask, the improvement comprising a viewing transom adapted to fit within the viewing port, the transom having a lower deck and an upper ceiling, the deck and ceiling each having horizontal top and bottom surfaces and front and back edges, the transom further having vertical side posts separating the deck and ceiling, the side posts, ceiling and deck defining an opening;

securing means for securing the transom to the mask; and projection means coupled to the transom within the opening and adapted to intercept the umpire's field of vision in one eye for projecting an image of a strike zone within said field of vision.

8. The improved mask according to claim 7 wherein the securing means comprises a plurality of straps, each attached to a side post and adapted to surround the side post and a mask brace; and at least one strap attached to the ceiling of the transom and adapted to surround a crosspiece of the mask.

9. The improved mask according to claim 7 wherein the projection means comprises a carriage having top, bottom and side walls defining an interior cavity open at the back of the carriage and a window communicating between the cavity and the front of the carriage;

fixing means for fixing the carriage to the transom within the umpire's field of vision in one eye comprising a first channel communicating between the top and bottom surfaces of the deck;

a second channel parallel the first channel and communicating between the top and bottom surfaces of the ceiling;

lugs on the top and bottom of the carriage, each lug adapted to be received within one of the channels; and a thumbscrew penetrating the first channel and into a threaded recess within the lug on the bottom of the carriage, the thumbscrew having a shoulder larger in diameter than the width of the first channel;

image means for creating a strike zone image within the umpire's field of vision comprising lens holder means within the cavity for holding at least one lens between the window and the umpire's eye;

focus means for adjusting the focus of the lens;

vertical lines superimposed onto a surface of the lens; and a horizontal bar adjustably coupled to the front of the carriage across the window.

10. A method by which an umpire may project a strike zone within his field of vision to aid him in visualizing a batter's strike zone, the method comprising providing an umpire's mask adapted to substantially shield the umpire's face, the mask having a viewing port transverse its vertical axis in front of the umpire's eyes;

providing a carriage adapted to translate across the umpire's field of vision within the viewing port and to be adjustably fixed in front of one of the umpire's eyes, the carriage comprising lens means adapted to intercept the field of vision of the umpire's eye;

focus means for focusing the lens; and image means for projecting an image of a strike zone within the umpire's vision, the image means comprising vertical lines superimposed onto a surface of the lens; and a horizontal bar coupled to the carriage in front of the lens; then donning the mask and adjusting the carriage to a position directly in front of one of the umpire's eyes; then focusing the lens; then aligning the vertical lines on the lens with the sides of the home plate; then tilting the umpire's head until the top of the lens aligns with the batter's shoulders and moving the horizontal bar vertically to align it with the batter's knees; then observing the location of a pitched ball in relation to the vertical lines, top of the lens and the bar as it crosses the strike zone plane for deciding whether or not the ball was within the strike zone as it crossed home plate.

11. A strike zone umpire's mask comprising a face shield symmetric about a vertical axis and adapted to be attached to the umpire's head;

a horizontal opening through the shield transverse the vertical axis;

a carriage coupled within the opening and having a cavity through which an image is viewed; and fixing means for adjustably fixing the carriage along the length of the opening in front of at least one of the umpire's eyes.

12. The mask according to claim 11 and further comprising image means carried within the cavity for creating an adjustable image of a strike zone within the field of vision of at least one eye of the umpire.

13. The mask according to claim 12 wherein the image means further comprises focusing means for focusing the image of a strike zone within the field of vision of at least one eye of the umpire.

14. The mask according to claim 11 and further comprising focusing means for focusing the image of a strike zone within the field of vision of at least one eye of the umpire.

* * * * *